US010828931B2

(12) United States Patent
Eizman

(10) Patent No.: US 10,828,931 B2
(45) Date of Patent: Nov. 10, 2020

(54) THREE-DIMENSIONAL VISUAL REPRESENTATIONS

(71) Applicant: Galit Eizman, Brookline, MA (US)

(72) Inventor: Galit Eizman, Brookline, MA (US)

( * ) Notice: Subject to any disclaimer, the term of this patent is extended or adjusted under 35 U.S.C. 154(b) by 339 days.

(21) Appl. No.: 15/884,228

(22) Filed: Jan. 30, 2018

(65) Prior Publication Data

US 2018/0215195 A1 Aug. 2, 2018

Related U.S. Application Data

(60) Provisional application No. 62/498,492, filed on Jan. 31, 2017.

(51) Int. Cl.

| | |
|---|---|
| ***B44C 1/22*** | (2006.01) |
| ***B05D 1/30*** | (2006.01) |
| ***B44C 3/04*** | (2006.01) |
| ***B05D 7/02*** | (2006.01) |
| ***B05D 5/06*** | (2006.01) |
| ***B05D 3/10*** | (2006.01) |

(52) U.S. Cl.

CPC ..... *B44C 1/22* (2013.01); *B05D 1/30* (2013.01); *B05D 3/101* (2013.01); *B05D 5/06* (2013.01); *B05D 7/02* (2013.01); *B44C 3/04* (2013.01); *B44C 3/044* (2013.01)

(58) Field of Classification Search

CPC .. B44C 1/22; B44C 3/04; B44C 3/044; B05D 1/30; B05D 7/02; B05D 5/06; B05D 3/101

See application file for complete search history.

(56) References Cited

U.S. PATENT DOCUMENTS 3,516,888 A * 6/1970 Bahner ..... B44C 5/0438 156/298
3,674,598 A * 7/1972 Mayer et al. ..... B44B 5/00 156/345.18

* cited by examiner

*Primary Examiner* — Michael C Miggins
(74) *Attorney, Agent, or Firm* — Law Offices of Daniel A. Tesler, LLC

(57) ABSTRACT

The present invention comprises a novel three-dimensional visual representation on the surface of an object formed by applying liquid nail polish or a solvent to polystyrene foam or any suitable polymer foam using well-known techniques. The products of the present invention have applications in venues including arts and crafts, topographic map-making, construction and household uses.

5 Claims, 3 Drawing Sheets

THREE-DIMENSIONAL VISUAL REPRESENTATIONS

CROSS REFERENCE TO RELATED APPLICATIONS

This application claims the benefit of U.S. Provisional Patent Application No. 62/498,492 filed Jan. 31, 2017, which is hereby incorporated by reference in its entirety.

FIELD OF THE INVENTION

The present invention relates to a novel polymeric object having a variety of predetermined multi-colored, carved surface patterns.

BACKGROUND OF THE INVENTION

Experimental art with non-conventional materials is a dynamic and broad field for artists, craftsmen, educators and applicators to explore. Traditionally, painters use oil- or water-based paint on a flat surface such as canvas, paper, and wood. In order to create three-dimensional art, sculptors and potters have used a variety of media, such as marble, wood, or clay to create unique shapes and designs. Alternatively, layering different types of materials on top of a surface creates raised shapes and textures for a three-dimensional effect. Artists and craftsmen have been experimenting with carving, sculpting, layering, and relief for a long time. The materials and tools for these processes may be difficult to procure and prohibitively costly. The techniques required to employ these tools and materials are well developed and practiced by skillful masters who pass on their trade to the next generation of artists, although they can require the kind and degree of training, time, and effort that are prohibitive for most people.

Less common, however, are products produced by methods for engraving or "carving" shapes, textures, and colors into a surface. There is a need for a novel method for carving into a surface which is easy, inexpensive, and useful in meeting a variety of needs. Indeed, the non-conventional products, process, and materials described herein offer endless possibilities for creating shapes, colors, textures as three-dimensional visual representations that may be used for artistic and utilitarian purposes. With an easier, enjoyable, and more accessible method, people who want to create three-dimensional visual representations with inexpensive materials and without in-depth training or practice will be able to do so.

BRIEF SUMMARY OF THE INVENTION

The present invention provides a cellular object having an outer and inner surface said outer surface comprising an arrangement of colored indentations present at a depth of from about 10 mils to about 500 mils, said arrangement present in the form of a predetermined pattern. In some embodiments, the cellular object comprises a cellular polystyrene plaque.

The objects of the present invention are prepared according to the steps of:

a. providing a polystyrene object,
b. selecting a variety of bottled, colored nail polish,
c. applying the nail polish to a surface of the object, in a predetermined sequence and in a predetermined pattern, and;

d. allowing the nail polish to penetrate the object and to dry.

The aforementioned steps provide a novel process for making, or "carving", three-dimensional, multi-colored shapes into a surface. Specifically, this process uses a solvent-based vehicle, such as nail polish, with an ethyl- or butyl-acetate base, to "carve" shapes into polystyrene foam. The terms "carve" and "carving" as used herein refer to the inset space resulting from the application of these solvents to a polystyrene foam surface. "Carver" as used herein refers to the person or manufacturer who is employing the method of this invention. "Nail polish" as used herein refers to a composition comprising polymeric binders, pigment, and solvent. Ethyl- or butyl-acetate are preferred solvents, although other polymer-dissolving solvents will produce similar results.

Carving shapes into a surface by causing a chemical and physical reaction is an unconventional method that requires neither sharp, complex, or expensive tools; nor highly-developed skills. In this case, the product is made by applying nail polish to polystyrene foam, causing the foam to dissolve, carving an inset shape in the surface of the foam and leaving pigment from the dried nail polish. This pigment from the nail polish colors the carved shape. Further, the surface of the foam forms a sticky liquid as it dissolves. Into this liquid, the carver can affix a variety of objects to the polystyrene foam. These objects can range from stones and toys to cloth and so on. This feature of affixed objects in the foam adds countless options for the final form of preferred embodiment and its uses. After the solvent evaporates, the polystyrene foam turns into a solid and objects affixed during the polystyrene foam's sticky liquid state are firmly adhered.

DETAILED DESCRIPTION OF THE INVENTION

Figure 1:
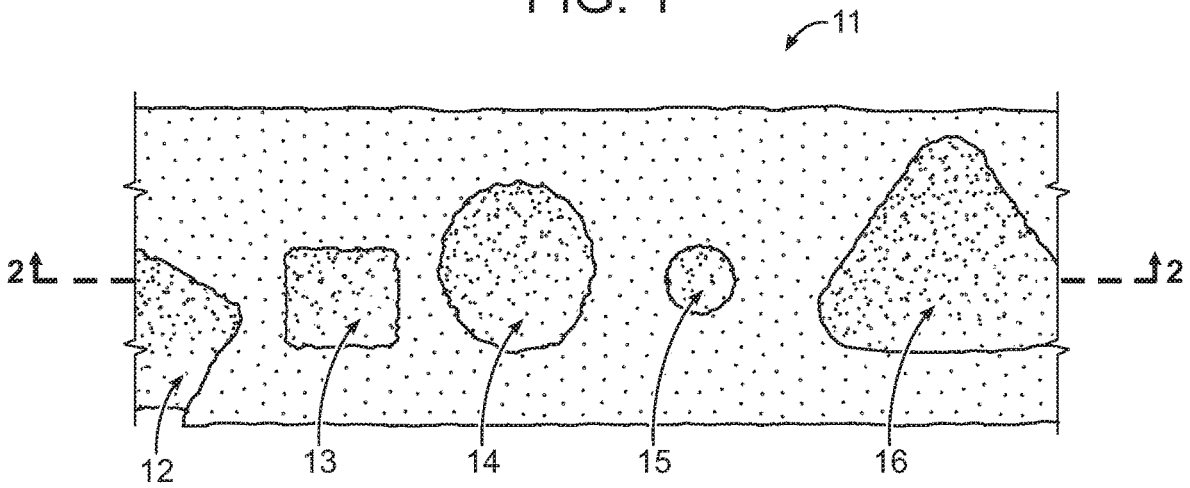
FIG. 1 is a top view of a segment of polystyrene foam that has undergone a process disclosed herein.
Figure 1A:
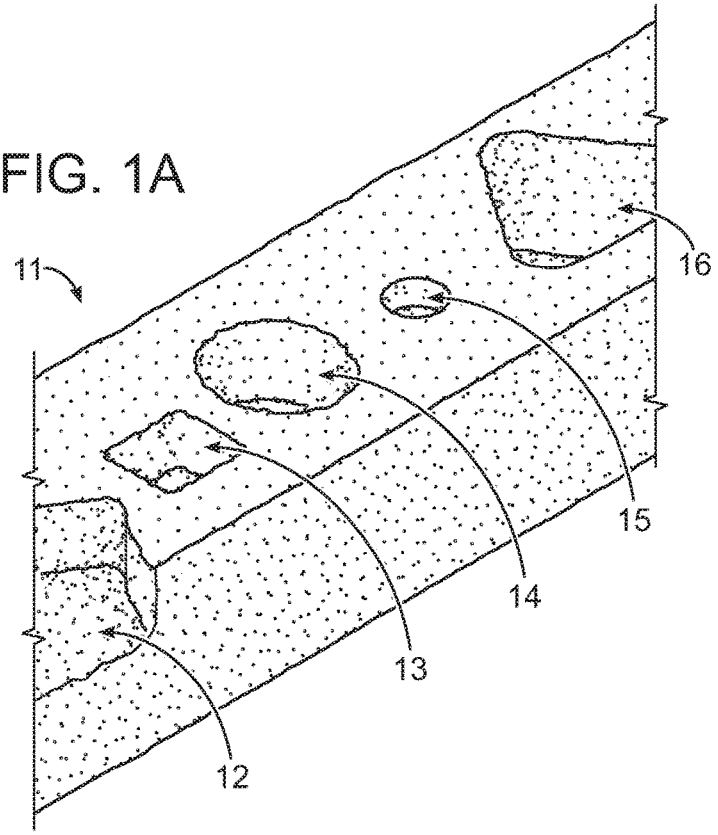
FIG. 1A is a perspective view of a segment of polystyrene foam that has undergone a process disclosed herein.

The terminology used herein is for the purpose of describing particular embodiments only and is not intended to be limiting of the invention. As used herein, the term "and/or" includes any and all combinations of one or more of the associated listed terms. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, components, and/or groups thereof.

Unless otherwise stated, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The product of the present invention is made by a novel process that will now be described. Nail polish and polystyrene foam are the primary two elements of preferred embodiment that are required to cause preferred embodiment of the physical and chemical reactions.

Any of the myriad types and kinds of nail polish may be used, including gel, "cracked," sparkled, shimmering, frosted and/or ordinary, matte-finish nail polish. The chemical composition of nail polish is made from nitrocellulose dissolved in butyl-acetate or ethyl-acetate. The nitrocellulose forms a shiny film as the acetate solvent evaporates. In addition, nail polish contains polymer resin, such a tosylamide/formaldehyde resin, that adds depth, gloss, and hardness to the film that remains after the acetate solvent evaporates. Camphor or other plasticizers are chemicals that help keep polish flexible and reduce the chance that it will crack or chip. They do this by linking to polymer chains and increasing the distance between them. Pigments are chemicals that add color to nail polish. Nail polish that has a shimmery or glittery effect may contain bits of plastic glitter or pearlescent minerals, such as titanium dioxide or ground mica. Nail polishes may contain thickening agents, such as stearalkonium hectorite. Some polishes contain ultraviolet filters, such as benzophenone-1, which help prevent discoloration when the polish is exposed to sunlight or other forms of ultraviolet light.

Polystyrene foam (commonly known as styrofoam) is the surface material to which the nail polish (solvent) is applied. Polystyrene foam, such as that used widely in commercial packaging, coffee cups and crafts materials (e.g., molds of heads, circular tubes), is a petroleum-based plastic made by stringing together, or polymerizing, styrene. In preferred embodiments, expanded polystyrene foam (EPF) is used. This material has special properties due to its structure of individual cells of low-density polystyrene.

In preferred embodiments, nail polish is applied to a surface of a polystyrene object. In some embodiments, the polystyrene object can be a polystyrene plaque. Since polystyrene objects may be provided in a multitude of shapes and configurations, the term "surface" refers to the location on the polystyrene object where the nail polish is applied. The surface can be the external surface of a polystyrene object or an internal surface carved using the process disclosed herein or another process. The nail polish can be applied in various ways, including but not limited to being poured onto the surface of a pre-molded shape of polystyrene foam and/or applied with a brush or poured in a predetermined shape. After a few moments, depending on the thickness of the nail polish, the polystyrene foam and the nail polish chemically and physically react and begin to bubble on the surface of the polystyrene foam as it dissolves. During this stage, objects may be affixed to the sticky liquid surface of the polystyrene foam to add to the three-dimensional effect of the result. As the surface of the dissolved polystyrene foam hardens, the pigment remains. In preferred embodiment, after the physical and chemical changes are complete, other materials may be applied to the product, such as paint, permanent markers, and cloth to further enhance the artistic and/or utilitarian value of the resulting product.

In another embodiment of the present invention, a solvent is applied to a surface of a polystyrene object to carve portions of the surface. Particularly effective solvents include acetone, butyl-acetate and ethyl-acetate, which are commonly used as the solvent in nail polish or nail polish remover. The solvent can be applied to the polystyrene object in a number of ways, including but not limited to, pouring the solvent or brushing the solvent onto the surface in a predetermined pattern.

The application of a solvent to polystyrene foam chemically melts or softens the polystyrene foam, allowing a person to carve into the surface of the polystyrene foam or mold an object out of the softened polystyrene foam. The concentration and volume of solvent applied to a polystyrene foam can be controlled to adjust the rate of reaction with the polystyrene foam. A solvent may be substituted in any of the methods described herein for nail polish.

The use of a solvent to melt or soften a volume of polystyrene foam can also be used in a method of producing a three-dimensional object without the use of blades or cutters. A person can first apply a solvent to a volume of polystyrene foam to soften the volume into a malleable material. The malleable material can then be molded by a person into a desired shape and left to set. When in a malleable state, objects may be set onto the surface of the malleable material that remain fixed to the surface when the material sets. The malleable material sets when the solvent evaporates out of the material, leaving a hardened volume of polystyrene foam. This method can be used for multiple applications, including artistic expressions, construction and household use. For instance, a person could use the malleable material to create a sculpture or other three-dimensional piece of art. Also, a person could use the malleable material to seal air leaks around a window, a wall or elsewhere in a dwelling. The polystyrene foam can be used in locations where an insulative property is desired, including but not limited to insulation from temperature, electrical insulation and insulation from impacts. Household uses include using the malleable material to form custom bump guards within a dwelling to reduce the occurrence of damage from swinging items. For instance, a person could attach the malleable material to the edge of a counter within the door swing of a refrigerator. Once the malleable material sets on the edge of a counter, it would be able to prevent impact damage to both the counter and refrigerator.

In FIG. 1 is a top view of an object 11 comprising polystyrene foam that has undergone the process disclosed herein. The volume of solvent applied to one area of the surface and the concentration of the solvent can impact the depth of the area carved. In FIG. 1, the carved areas 12 & 16 were created by applying a predetermined amount of solvent to a surface of the object 11. The carved areas 13, 14 & 15 were created by applying a predetermined amount of nail polish to a surface of the object 11. The shapes and depths of the carved areas 12-16 are merely exemplary and are intended only to show the possibilities of the disclosed methods. The carved areas 12-16 could be any shape or depth imaged by a person applying the disclosed methods.

Figure 2:
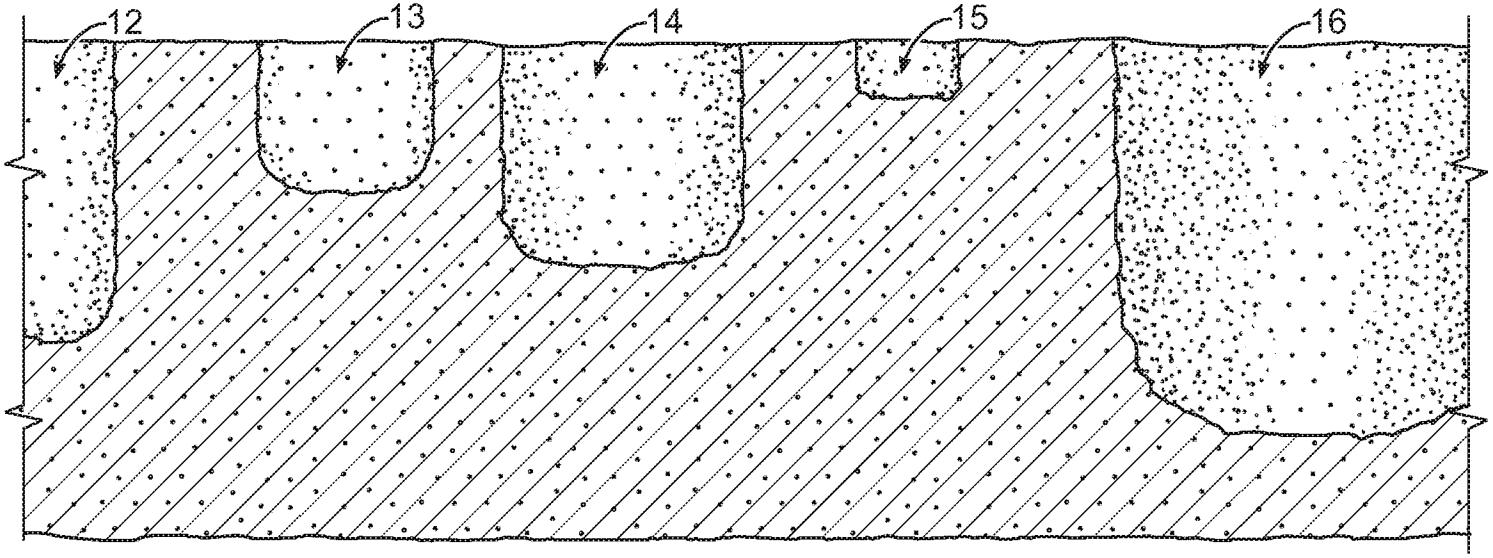
FIG. 2 is a side sectioned view, taken along section 2-2 shown in FIG. 1, of the segment of polystyrene foam that has undergone a process disclosed herein.

In FIG. 2 is a side sectioned view of the object 11 taken along section 2-2 identified in FIG. 1. The carved areas 12 & 16 created by applying solvent are deeper than the carved areas 13, 14 & 15 created by applying nail polish because the solvent used had a higher concentration of butyl-acetate or ethyl-acetate than the nail polish. In some embodiments, the depth of the carved areas is adjusted by changing the concentration of butyl-acetate or ethyl-acetate in the solvent or nail polish applied to the surface. In some embodiments, the depth of the carved areas is adjusted by changing the volume of solvent or nail polish applied to the surface.

Figure 3:
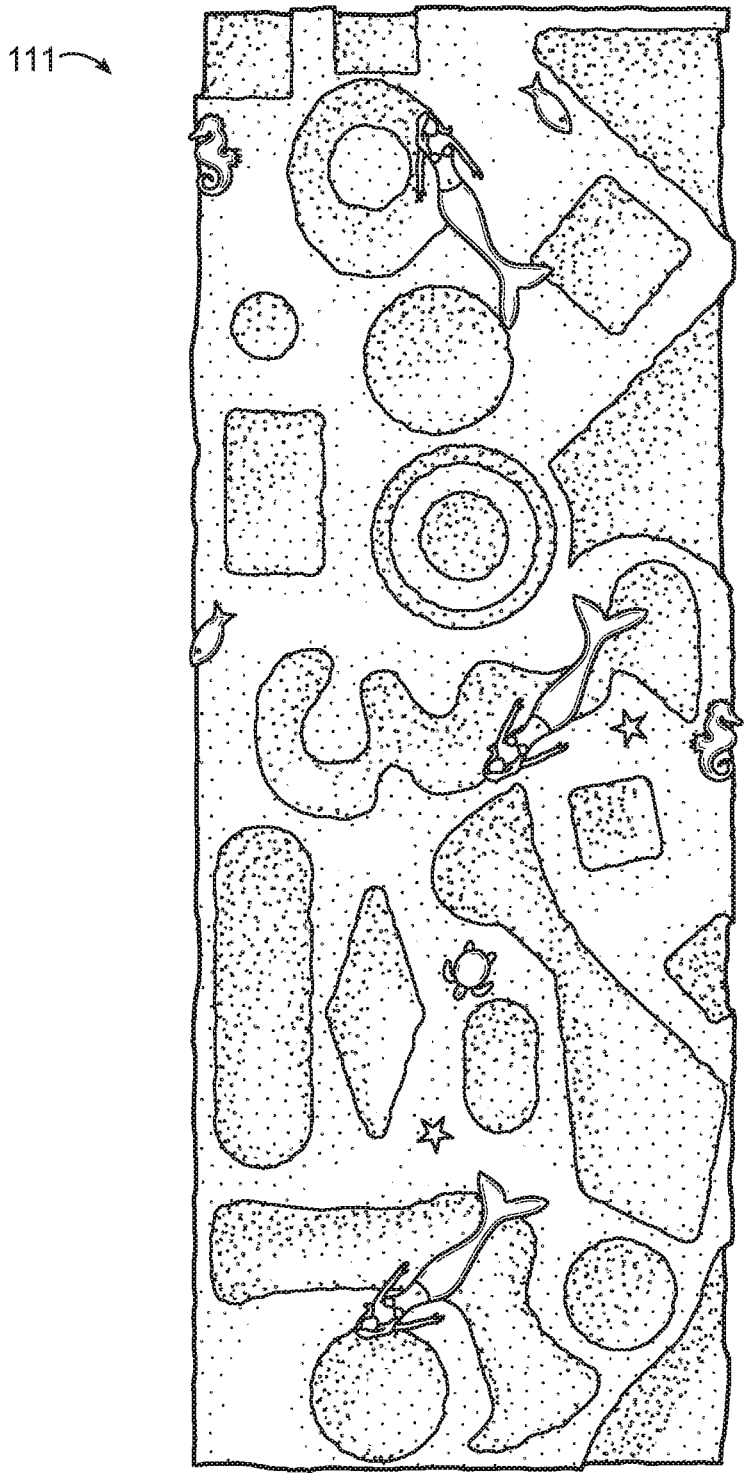
FIG. 3 illustrates an artistic use of preferred embodiment.

In FIG. 3 is an exemplary artistic expression created using the process disclosed herein. FIG. 3 contains a polystyrene tablet 111 with various carved areas of different depths and shapes. The exemplary artistic expression in FIG. 3 is merely one example of many types of artistic expressions that are possible using the disclosed methods. The artistic expression in FIG. 3 includes indentations in the surface as well as objects fixed to the surface accomplished by placing the objects on softened portions of the polystyrene tablet and leaving them to set. Other artistic expressions include other variations of the disclosed methods applied to polystyrene tablets, three-dimensional polystyrene volumes and sculpted polystyrene volumes created by melting or softening a volume of polystyrene foam, molding it into a particular shape and allowing it to set.

In another embodiment of the present invention, three-dimensional reproductions of maps, charts, and posters are provided. For example, in the map of a park, an indented pathway may be created. In another embodiment, this invention provides a topographic map that would have practical value to hikers, campers, snow skiers, city and county planners, Fish and Wildlife Service personnel, miners, loggers, highway planners and construction workers, travelers, surveyors, geologists, engineers, military personnel, and/or scientists.

In another embodiment of the present invention, three-dimensional reproductions of instructional models are provided. In this embodiment, models of objects, shapes, and processes can be produced and used by teachers in the classroom for instructional purposes.

In another embodiment of the present invention, solvent or nail polish can be used to melt of soften a large volume of polystyrene foam to be reshaped. When a sufficient amount of a solvent or nail polish is applied to polystyrene foam, the foam softens considerably, turning into a gel-like substance that can be sculpted into a three-dimensional shape. When the polystyrene foam hardens, it retains its newly sculpted shape. Sculpting polystyrene foam without the use of sharp instruments could be useful in various applications, including but not limited to, artistic expressions and construction.

A person skilled in the art will understand that invention according to this disclosure may be conducted with various changes without dividing from the ideas of this invention.

What is claimed is:

1. A method of preparing a cellular object, comprising: an outer surface; an inner volume; said outer surface comprising an arrangement of indentations present at a depth of from about 10 mils to about 500 mils; where said indentations extend into said inner volume; and said arrangement present in the form of a predetermined pattern, wherein said object further comprises a plaque comprising the steps of:

a. providing a polystyrene plaque, b. selecting a solvent, c. applying the solvent onto the outer surface of the plaque, in a predetermined sequence and in a predetermined pattern, and;

d. allowing a nail polish to penetrate the plaque and to dry.

2. The method of claim 1, further comprising:

wherein said solvent is contained in a solution of nail polish.

3. The method of claim 2, wherein the step of applying the solvent further comprises pouring the solvent in the form of a fine stream.

4. The method of claim 3, wherein the step of selecting a solvent further comprises selecting a variety of bottled, colored nail polish.

5. The method of claim 2, wherein said solvent is selected from the group consisting of butyl-acetate and ethyl-acetate.

* * * * *